US006301836B1

(12) United States Patent
Richardson

(10) Patent No.: US 6,301,836 B1
(45) Date of Patent: Oct. 16, 2001

(54) GUTTERING

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/506,116

(22) Filed: Feb. 17, 2000

(30) Foreign Application Priority Data

Mar. 13, 1999 (GB) ..... 9906086

(51) Int. Cl.[7] ..... E04D 13/00
(52) U.S. Cl. ..... 52/11; 248/48.1; 248/48.2
(58) Field of Search ..... 52/11; 248/48.1, 248/48.2

(56) References Cited

U.S. PATENT DOCUMENTS 2,144,663 1/1939 Petersen .
3,150,851 * 9/1964 Ritchie et al. ..... 52/11
4,996,809 3/1991 Beard .
5,046,692 * 9/1991 Nicholas ..... 248/48.2

FOREIGN PATENT DOCUMENTS 1310167 11/1992 (CA) .
629060 9/1949 (GB) .
2236776 4/1991 (GB) .
2311308 9/1997 (GB) .
2330846 5/1999 (GB) .

* cited by examiner

*Primary Examiner*—Carl D. Friedman
*Assistant Examiner*—Chi Nguyen
(74) *Attorney, Agent, or Firm*—Rockey, Milnamow Katz, Ltd.

(57) ABSTRACT

Gutters have on opposed side walls formations for engagement with ends of gutter straps, which ends include deformable formations for securement thereof to the gutter side wall formations.

9 Claims, 1 Drawing Sheet

GUTTERING

BACKGROUND OF THE INVENTION

This invention concerns improvements in and relating to guttering.

To support guttering against distortion it is customary to provide straps linking opposite walls of the gutter channel at spaced intervals along the gutter. Such straps have to be fitted in advance of fixing the guttering to a structure. Indeed for metal guttering it is conventional to weld gutter straps in position.

SUMMARY OF THE INVENTION

An object of this invention is to provide a gutter strap which may be fitted on site and to provide guttering suitable for receiving gutter straps on site.

According to this invention it is proposed that gutters have on opposed side walls formations for engagement with ends of gutter straps, which ends include deformable formations for securement thereof to the gutter side wall formations.

The side wall formations of the gutters are preferably channels formed by inverted generally L-shaped flanges along the gutter side walls. The gutter straps preferably have upturned ends that fit into the channels. Outer surfaces of the upturned ends of the gutter strap are preferably arcuate at least in part.

The deformable formations of gutter strap ends are preferably arranged to lock over the L-shaped flange of the gutter side walls when the strap is in position. Preferably extending inwardly from the gutter strap ends is a deformable web having a flange on one side that will overlie a gutter side wall flange when the deformable web is urged towards the upturned end of the strap from which it extends. The deformable web preferably has on its opposite side a second flange to act as a lever for deforming said web to lock or release the strap. Preferably the strap itself has a protrusion near each end on its top surface to provide a fulcrum for a lever tool, such as a screwdriver, to act on the lever flange of the deformable web.

Preferably the gutter straps of the invention will be manufactured from aluminium.

The invention may provide various advantages over the prior art. In particular, gutter straps of the invention may be fitted on site. There is no need to weld them in position beforehand. They can be easily removed and their spacing is easily adjustable.

BRIEF DESCRIPTION OF THE DRAWING

This invention will now be further described, by way of example only, with reference to the accompanying drawing, which is an end view of a gutter with a gutter strap according to the invention being fitted.

DETAILED DESCRIPTION OF THE INVENTION

Figure 1:
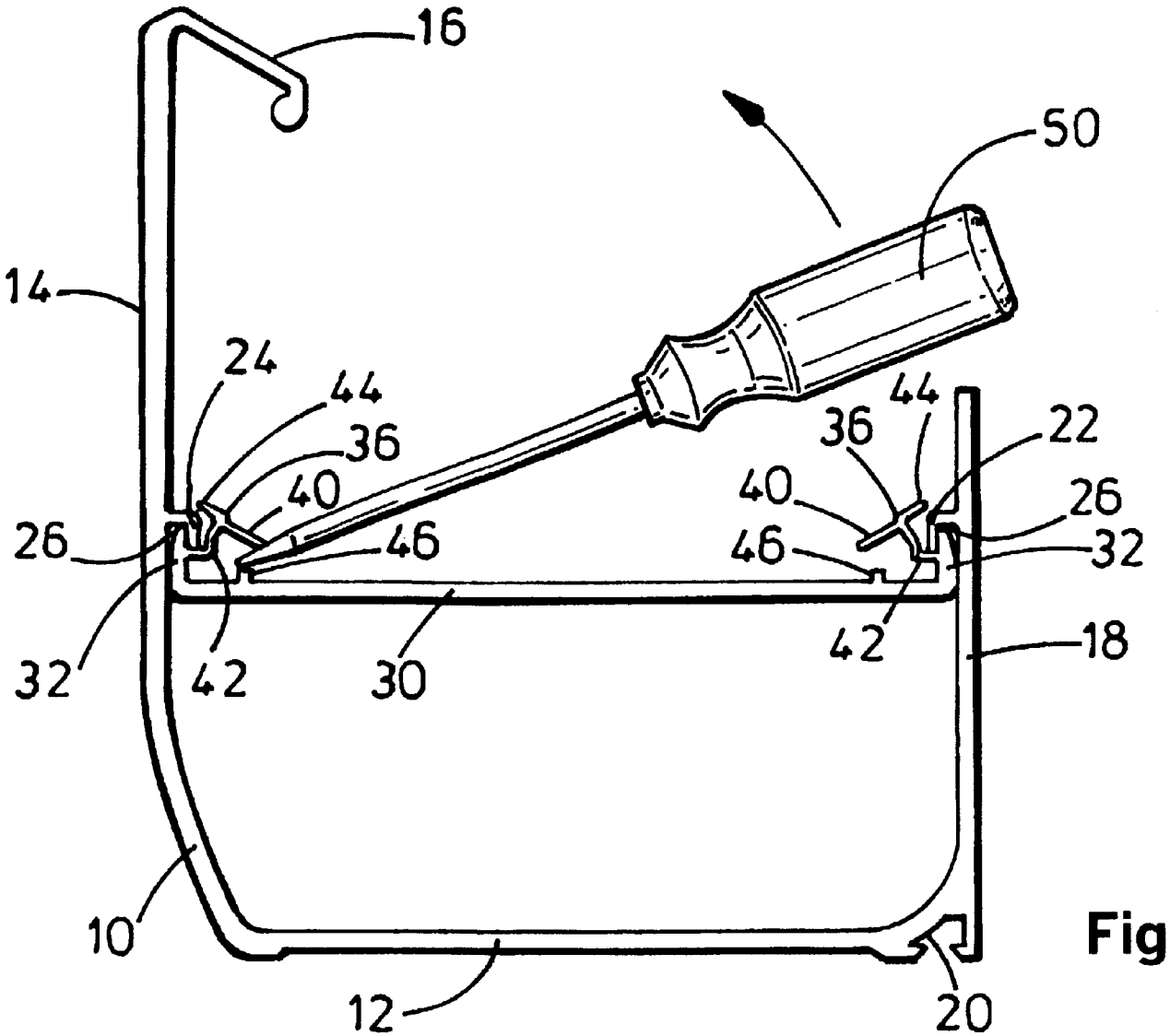

Referring to the accompanying drawing a gutter 10 is a channel section having a base 12, a taller side 14 with an inwards overhang 16 and a shorter side 18, which will be adjacent a structure, such as a conservatory. The overhang 16 serves to support a roof structure, typically glazing bars supporting glazing panels. At the junction of the base 12 and side wall 18 is a shaped longitudinal slot 20 for receiving a fixing component for securing the gutter to the adjacent structure.

Both side walls 14 and 18 have on the opposing faces an inverted L-shaped flange 22, 24 respectively forming downwardly open channels 26 with their respective side walls. These channels are to receive ends of a gutter strap 30.

Each end of the gutter strap 30 has an upturn 32 whose outer surface 34 is arcuate. Extending inwardly from each end 32 is a deformable formation 36 having a securing part and a lever part 40. The securing part has a first deformable web 42 extending from the end 32 and a second web 44 normal to the first web. The lever part 40 extends oppositely to the second web 44. The strap 30 also has near each end on its intended top surface a fulcrum 46.

The gutter strap is fitted to a gutter section in the following manner. The ends 32 of the strap are fitted into a respective channel 26. The arcuate shaping of the ends 32, facilitates that fitment. Then the formations 36 are bent over using a screwdriver 50 or another convenient tool, the screwdriver being pivoted around a fulcrum 46 to act against the lever part 40, so that the part 38 fits over the L-shaped flange 22 or 24 to secure the strap in place.

To remove the gutter strap downward pressure is applied to the lever parts 40 of the deformable formations 36. That action releases the deformable formations 36 from the L-shaped flanges 22, 24, so that the strap can be lifted out of the gutter.

The side 18 of the gutter which bears the weight of the roof structure supported on overhang 16 can be distorted by the weight and the bottom corner of the gutter on side 18 forced downwards. The strap 30 serves to brace the gutter across its width to fixed side 18 against such distortion.

The gutter straps are desirably sited at optimum structured positions, which may be in the region of the glazing bars of the supported roof structure.

What is claimed is:

1. A gutter and gutter strap combination, the gutter having a base and opposed side walls extending upwardly from the base and the gutter strap having ends, the gutter having formations on the opposed side walls for engagement with the ends of the gutter strap, which ends include deformable formations adapted for securement of each end directly to one of the gutter side wall formations, wherein the gutter side wall formations are channels formed by L-shaped flanges along the gutter side walls.

2. A gutter and gutter strap combination, the gutter having a base and opposed side walls extending upwardly from the base and the gutter strap having ends, the gutter having formations on the opposed side walls for engagement with the ends of the gutter strap, which ends include deformable formations adapted for securement of each end directly to one of the gutter side wall formations, wherein the gutter side wall formations are channels formed by inverted L-shaped flanges along the gutter side walls.

3. A combination as claimed in claim 2, wherein the gutter strap has upturned ends that fit into respective channels of the gutter side walls.

4. A combination as claimed in claim 3, wherein said upturned ends have outer surfaces that are at least in part arcuate.

5. A combination as claimed in claim 2, wherein the deformable formations are arranged to lock over the L-shaped flanges of the gutter side walls when the strap is in position.

6. A combination as claimed in claim 5, wherein extending inwardly from each gutter strap end is a deformable web having a flange on one side that overlies a gutter side wall flange when the web is urged towards the upturned end of the strap from which it extends.

7. A combination as claimed in claim 6, wherein the deformable web has on its opposite side a second flange to act as a lever for deforming said web to lock or release the strap.

8. A combination as claimed in claim 7, wherein the strap has a protrusion near each end on its surface to provide a fulcrum for a lever tool to act on the lever flanges of the deformable web.

9. A combination as claimed in any one of claims 1 to 8, wherein the gutter strap is made of aluminium.

* * * * *